United States Patent [19]

Okano

[11] Patent Number: 4,945,616

[45] Date of Patent: Aug. 7, 1990

[54] ADJUSTABLE CLOSURE FOR OVERLAPPING PARTS

[75] Inventor: Shunsuke Okano, Nara, Japan

[73] Assignee: Morito Co., Ltd., Osaka, Japan

[21] Appl. No.: 472,625

[22] Filed: Jan. 30, 1990

[30] Foreign Application Priority Data

Apr. 26, 1989 [JP] Japan ..... 1-49452[U]

[51] Int. Cl.[5] ..... A44B 19/00

[52] U.S. Cl. ..... 24/585; 24/170

[58] Field of Search ..... 24/585, 170, 614, 584, 24/194, 698

[56] References Cited

U.S. PATENT DOCUMENTS

| | | | |
|---|---|---|---|
| 2,054,840 | 9/1936 | Statham | 24/585 |
| 3,872,554 | 3/1975 | Wolfertz et al. . | |
| 3,988,812 | 11/1976 | Kanzaka | 24/585 |
| 4,545,096 | 10/1985 | Belter et al. | 24/585 |
| 4,780,939 | 11/1988 | Belter et al. | 24/585 |

FOREIGN PATENT DOCUMENTS

| | | |
|---|---|---|
| 50072746 | 6/1975 | Japan . |
| 5458412 | 9/1977 | Japan . |

*Primary Examiner*—Victor N. Sakran
*Attorney, Agent, or Firm*—Roger J. French

[57] ABSTRACT

An adjustable closure for overlapping parts of clothing comprising a rail 1 and a slide 2. The rail 1 has a plurality of projections 4, and is attached to one of the overlapping parts. The slide 2 comprises a mounting frame 13, an actuating frame 20 and sheet spring 21, and is attached to the other overlapping part. The mounting frame 13 has a bottom 9, rear walls 10*a* each having a ceiling 11*a*, and front walls 10*b* each having a ceiling 11*b* at the lateral ends of the bottom 9, engaging strips 14 at the rear edges of the rear walls 10*a*, slanted edges 10*c* at the rear edges of the front walls 10*b*. The bottom 9, front and rear walls 10*a*, 11*a* and ceilings 10*b*,11*b* make a sliding space having a width that allows the movement of the rail 1. The actuating frame 20 has lateral walls 16 and a cover 17, holes 22 supporting the engaging strips 14, and corners 15, which become fulcra of the movement of the actuating frame 20, claws 16*a* which abut on the slanted edges 10*c* of the mounting frame 13, an engaging tongue 18 which is engageable with one of the projections 4 and an engagement-releasing actuating strip 19. The sheet spring 21 is attached to the bottom 9 of the mounting frame 13.

2 Claims, 4 Drawing Sheets

ADJUSTABLE CLOSURE FOR OVERLAPPING PARTS

BACKGROUND OF THE INVENTION

This invention relates to a closure for overlapping parts of articles of clothing, such as a waist band, and is used to adjust the length of such overlapping parts.

Heretofore, such closures have been known from such inventions as Patent Laid-Open No. 50-72746 and Utility Model Laid-Open No. 54-58412, for instance. In these techniques, pockets are separated till the top end of the waist band and overlapping parts are prepared in advance. A rail is provided on the inside sheet of the overlapping parts and a slider which slides along the rail is attached to the outside sheet.

In the closure of Patent Laid-Open No. 50-72746, since the end of the inside sheet is a free end to be engaged with the slide, the engagement of the two parts may be released accidentally.

As to the closure of Utility Model Laid-Open No. 54-58412, in which a cover is provided to prevent the engaging projections from exposing outside, the construction become complicated. Besides, the engaging structure of the rail and the slide appears to be not so strong as to hold the two parts in secure engagement.

The present invention, which was accomplished in view of the drawbacks of the prior techniques, has its object the provision of a new closure of overlapping parts, in which the construction is simpler and the closure engagement is strong.

SUMMARY OF THE INVENTION

The adjustable closure for overlapping parts of clothing according to the present invention comprises (A) a rail having a plurality of projections, said rail being attached to one of the overlapping parts, (B) a slide comprising a mounting frame, an actuating frame and sheet spring, said slide being attached to the other overlapping part:

(a) said mounting frame having a bottom, rear walls each having a ceiling, and front walls each having a ceiling at the lateral ends of the bottom, said bottom, front and rear walls and ceilings make a sliding space having a width that allows the movement of the rail, engaging strips at the rear edges of the rear walls, slanted edges at the rear edges of the front walls, (b) said actuating frame having lateral walls and a cover, holes supporting the engaging strip, and corners, which become fulcra of the movement of the actuating frame, claws which abut on the slanted edges of the mounting frame, an engaging tongue which is engagable with one of the projections and an engagement-releasing actuating strip, and (c) said sheet spring being attached to the bottom of the mounting frame.

Preferably, the holes supporting the engaging strips are horizontal elongated holes.

BRIEF DESCRIPTION OF THE DRAWINGS

The invention will be described in detail with reference to the appended drawings, in which.

DETAILED DESCRIPTION OF THE PREFERRED EMBODIMENT

Figure 1:
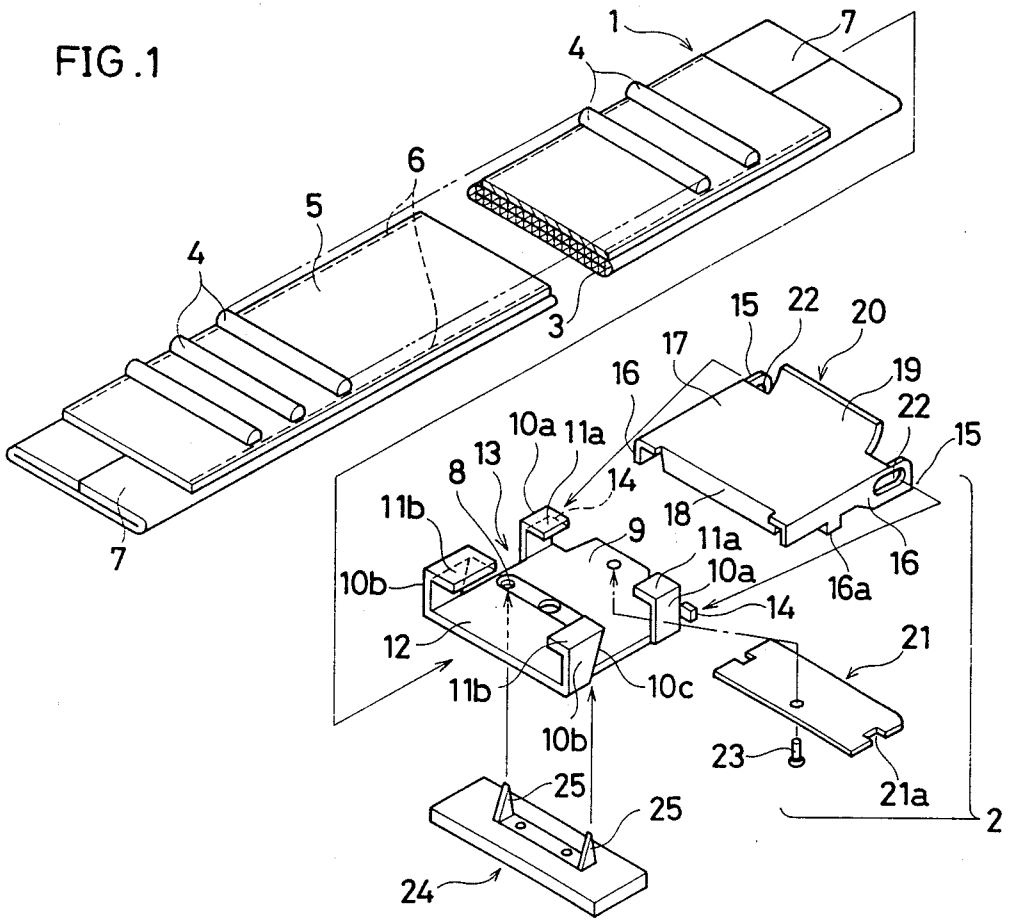
FIG. 1 is an exploded perspective view of the closure in accordance with the present invention.

Referring to FIG. 1, the closure of the present invention comprise a rail 1 and a slide 2.

The rail 1 comprises a main plastic sheet body 5 and a textile mounting belt 3. The main body 5 has a plurality of projections 4 provided at equal intervals and extending to the width direction. The belt 3 has extended portions 7 at both ends thereof. The main body 5 and the belt 3 are combined along the longitudinal lateral ends 6 by sewing, etc.

The slide 2 comprises a metal mounting frame 13, actuating frame 20, a sheet spring 21 and a metal button 24.

The mounting frame 13 has a bottom 9 having a mounting hole 8 in a portion projecting downward. The lateral ends of the bottom 9 are bent inward to make rear walls 10*a* each having a ceiling 11*a*, and front walls 10*b* each having a ceiling 11*b*. The bottom 9, front and rear walls 10*a*,10*b* and ceilings 11*a*,11*b* make a sliding space 12 having a width that allows the movement of the rail 1. The rear edges of the rear walls 10*a* are bent outward to make strips 14 used as engaging axis. The rear edges of the front walls 10*b* are cut away to make slanted edges 10*c*.

The actuating frame 20 comprise lateral walls 16 and a cover 17. At the rear end of the lateral walls 16, there is provided elongated horizontal holes 22, which support the axis strips 14, and corners 15, which become fulcra of the movement of the actuating frame 20. The middle portions of the lateral walls 16 have claws 16*a* which abut on the slanted edges 10*c* of the amounting frame 13. The front edge of the cover 17 is bent inward to make an engaging tongue 18. The rear edge of the cover 17 is curled to make an engagement-releasing actuating strip 19.

The sheet spring 21 is fixed to the bottom 9 by a pin 23 or by welding in such a manner that the corners 15 may abut on the free end of of the spring 21. The sheet spring 21 has small cutout portions 21a at both lateral ends.

Figure 2B:
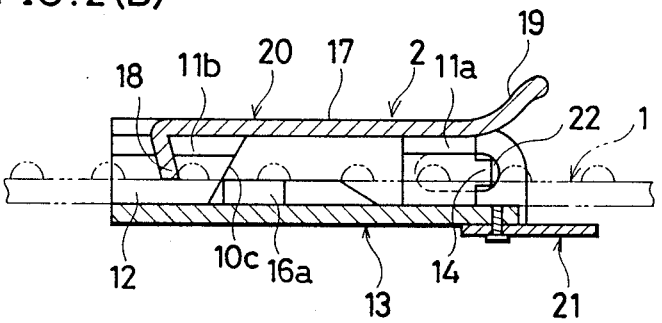
Figure 3:
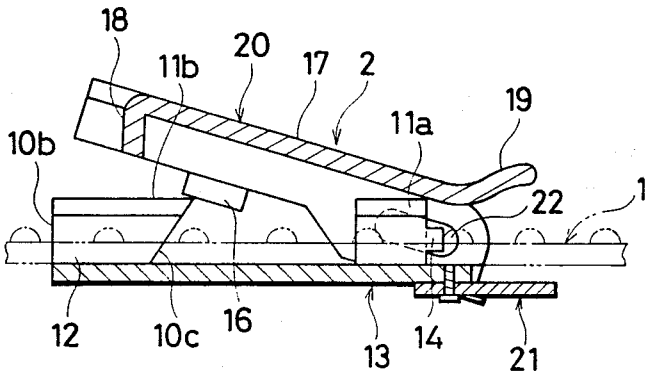
FIG. 3 is a sectional view of the closure when engaged with the rail

As shown in FIG. 3, when the actuating strip 19 is pressed by applying finger force, the corners 15 enters the cutout portions 21*a* of the sheet spring 21 and press the free end thereof, so that the engaging tongue 18 of the actuating frame 20 moves upward. In this condition in which the claws 16*a* is raised above the ceilings 11*b*, the rail 1 is inserted into the sliding space 12 to combine the two parts. As shown in FIG. 2(B), when the force applied to the actuating frame is released, the engaging tongue 18 engages with one of the projections 4 of the rail 1.

The metal button 24 in FIG. 1 is combined with the slide 2 when in use. The surface of the button 24 is usually decorated, and the reverse side is provided with sharpened legs 25.

Figure 5:
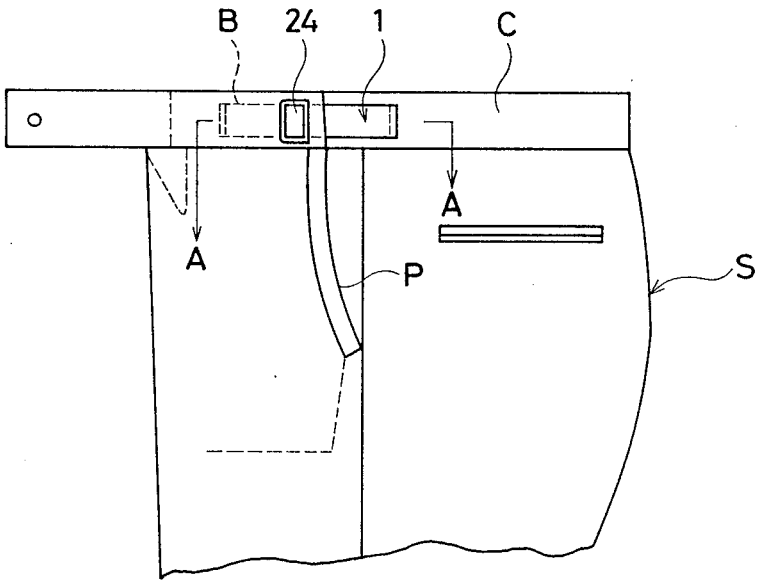
FIG. 5 is a view showing how the closure is attached to trousers.

Two closures in accordance with the present invention are put on the side pockets P of trousers S as shown in FIG. 5. Each edge of side pockets P of the trousers S must be separated till the upper end and overlapping sheets B (outside sheet) and C (inside sheet) must be prepared beforehand.

Figure 4:
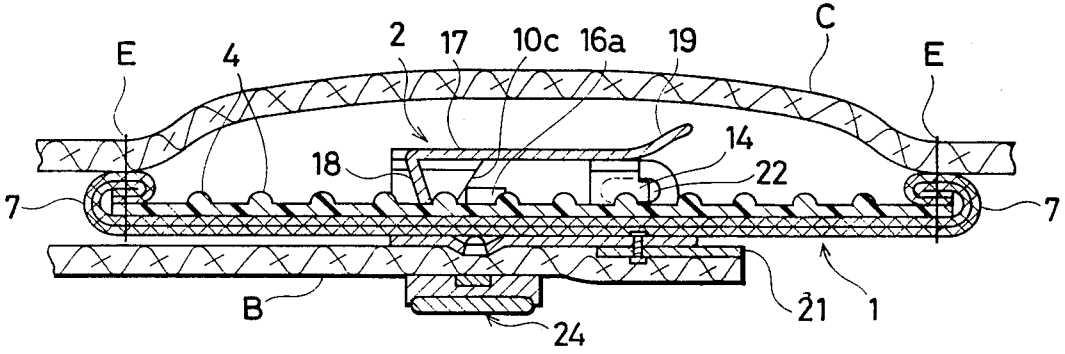
FIG. 4 is a sectional view taken along the line 4—4 in FIG. 5.

The rail 1 is attached to the outside sheet B, and the slide 2 is attached to the inside sheet C, as shown in FIG. 4 and FIG. 5.

As shown in FIG. 4, each of the extended portions 7 of the rail 1 are bent inward and, together with each of the ends of the main body 5 of the rail 1, attached to the outside sheet C at the point E by sewing etc. The legs 25 of the button 24 are penetrated into the sheet B to which the slide 2 is provided, and are inserted into the mounting hole 8 of the bottom 9 and then the tips of the legs are bent inward, thereby the sheet B and the slide 2 can be combined together.

In order to tighten the waist band of the trousers S, in FIG. 5, the wearer holds the top of the inside sheet C and the end of the outside sheet B by fingers and pull the end of the outside sheet B to the right direction in FIG. 4 and FIG. 5. The engaging tongue 18 of the slide 2 moves to the left, overriding the projections 4 of the rail 1, thereby the length of the waist can be tightened as desired.

Figure 2A:
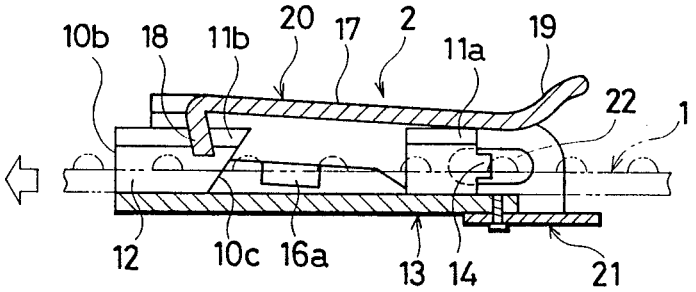
FIGS. 2(A) and 2(B) are sectional views of the closure showing how the slide moves.

In this tightened condition, when the waist thickens temporarily by rapid movement, for example, in which the inside sheet C tends to move to the right as in FIG. 2(A), the actuating frame 20 moves a little within the range of the long hole 22, the claw 16*a* abuts on the slanted edge 10*c* as shown in FIG. 2(B). The engaging tongue 18 is pull down toward the root of one of the projections, thereby the tightened state can be maintained in spite of the thickened waist.

To slacken the waist band, the wearer puts a finger between the outside sheet C and the slide 2 and another finger on the button 24 in FIG. 4, and presses the actuating strip 19. The actuating frame 20 is erected due to the function of the corners 15 and the sheet spring 21, as described above, disengaging the tongue 18 with one of the projections 4. The wearer then chooses the suitable waist band length and the new position is fixed again.

While the embodiment of the present invention as herein disclosed constitute a preferred form, it is to be understood that other forms might be adopted. For example, the belt 3 may be omitted and a comparatively thick yet flexible rail 1 alone could be adopted in its place.

I claim:

1. An adjustable closure for overlapping parts of clothing comprising:

(A) a rail having a plurality of projections, said rail being attached to one of the overlapping parts, (B) a slide comprising a mounting frame, an actuating frame and sheet spring, said slide being attached to the other overlapping part:

(a) said mounting frame having a bottom, rear walls each having a ceiling, and front walls each having a ceiling at the lateral ends of the bottom, said bottom, front and rear walls and ceilings make a sliding space having a width that allows the movement of the rail, engaging strips at the rear edges of the rear walls, slanted edges at the rear edges of the front walls, (b) said actuating frame having lateral walls and a cover, holes supporting the engaging strips, and corners, which become fulcra of the movement of the actuating frame, claws which abut on the slanted edges of the mounting frame, an engaging tongue which is engagable with one of the projections and an engagement-releasing actuating strip, and (c) said sheet spring being attached to the bottom of the mounting frame.

2. A closure according to claim 1, wherein the holes supporting the engaging strips are horizontal elongated holes.

* * * * *